US006202219B1

(12) United States Patent
Cheever

(10) Patent No.: US 6,202,219 B1
(45) Date of Patent: Mar. 20, 2001

(54) ADJUSTABLE HEADWEAR FOR A CHILD

(76) Inventor: Susan L. Cheever, 18 Sherwood Dr., Sterling, MA (US) 01564

( * ) Notice: Subject to any disclaimer, the term of this patent is extended or adjusted under 35 U.S.C. 154(b) by 0 days.

(21) Appl. No.: 09/453,628

(22) Filed: Dec. 3, 1999

(51) Int. Cl.[7] ..... A42B 1/00
(52) U.S. Cl. ..... 2/195.2; 2/175.1; 2/918
(58) Field of Search ..... 171/171, 183, 171/195.1, 195.2, 195.4, 209.12, 209.3, 175.1, 918

(56) References Cited

U.S. PATENT DOCUMENTS 1,274,652 * 8/1918 Winget ..... 2/171
1,369,971 * 3/1921 Goodrick ..... 2/171
2,066,713 * 1/1937 Bowland ..... 2/171
4,815,148 * 3/1989 Satterfield ..... 2/197
5,331,687 * 7/1994 Kronenberger ..... 2/195.2
5,669,076 * 9/1997 Steffy ..... 2/195.2
5,685,017 * 11/1997 Kraft ..... 2/171.1

* cited by examiner

*Primary Examiner*—John J. Calvert
*Assistant Examiner*—Katherine Moran

(57) ABSTRACT

A adjustable headwear for a child for allowing the child to continue to wear the hat or bonnet as the child grows. The adjustable headwear for a child includes a crown member having a bottom edge and a top portion and being split through and from the bottom edge to a middle of the top portion thus forming a first end portion having a longitudinal edge and also forming a second end portion having a longitudinal edge, and also includes a bill member which is sewn to and extends from the crown member, and further includes a plurality of hook and loop fasteners which are sewn upon the exterior of the crown member along the longitudinal edge of the first end portion and which are also sewn on the underside of the crown member upon the second end portion. The second end portion is adjustably attached upon the first end portion to accommodate different head sizes of children wearing the adjustable headwear.

7 Claims, 1 Drawing Sheet

ADJUSTABLE HEADWEAR FOR A CHILD

BACKGROUND OF THE INVENTION

1. Field of the Invention

The present invention relates to an adjustable hat or bonnet for a child and more particularly pertains to a new adjustable headwear for a child for allowing the child to continue to wear the hat or bonnet as the child grows.

2. Description of the Prior Art

The use of adjustable hat or bonnet for a child is known in the prior art. More specifically, adjustable hat or bonnet for a child heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,815,148; U.S. Pat. No. 5,724,676; U.S. Pat. No. 5,669,076; U.S. Pat. No. 5,548,845; U.S. Pat. No. 5,025,504; and U.S. Pat. No. Des. 391,388.

While these devices fulfill their respective, particular objectives and requirements, the aforementioned patents do not disclose a new adjustable headwear for a child. The inventive device includes a crown member having a bottom edge and a top portion and being split through and from the bottom edge to a middle of the top portion thus forming a first end portion having a longitudinal edge and also forming a second end portion having a longitudinal edge, and also includes a bill member which is sewn to and extends from the crown member, and further includes a plurality of hook and loop fasteners which are sewn upon the exterior of the crown member along the longitudinal edge of the first end portion and which are also sewn on the underside of the crown member upon the second end portion. The second end portion is adjustably attached upon the first end portion to accommodate different head sizes of children wearing the adjustable headwear.

In these respects, the adjustable headwear for a child according to the present invention substantially departs from the conventional concepts and designs of the prior art, and in so doing provides an apparatus primarily developed for the purpose of allowing the child to continue to wear the hat or bonnet as the child grows.

SUMMARY OF THE INVENTION

In view of the foregoing disadvantages inherent in the known types of adjustable hat or bonnet for a child now present in the prior art, the present invention provides a new adjustable headwear for a child construction wherein the same can be utilized for allowing the child to continue to wear the hat or bonnet as the child grows.

The general purpose of the present invention, which will be described subsequently in greater detail, is to provide a new adjustable headwear for a child which has many of the advantages of the adjustable hat or bonnet for a child mentioned heretofore and many novel features that result in a new adjustable headwear for a child which is not anticipated, rendered obvious, suggested, or even implied by any of the prior art adjustable hat or bonnet for a child, either alone or in any combination thereof.

To attain this, the present invention generally comprises a crown member having a bottom edge and a top portion and being split through and from the bottom edge to a middle of the top portion thus forming a first end portion having a longitudinal edge and also forming a second end portion having a longitudinal edge, and also includes a bill member which is sewn to and extends from the crown member, and further includes a plurality of hook and loop fasteners which are sewn upon the exterior of the crown member along the longitudinal edge of the first end portion and which are also sewn on the underside of the crown member upon the second end portion. The second end portion is adjustably attached upon the first end portion to accommodate different head sizes of children wearing the adjustable headwear.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable headwear for a child which has many of the advantages of the adjustable hat or bonnet for a child mentioned heretofore and many novel features that result in a new adjustable headwear for a child which is not anticipated, rendered obvious, suggested, or even implied by any of the prior art adjustable hat or bonnet for a child, either alone or in any combination thereof.

It is another object of the present invention to provide a new adjustable headwear for a child which may be easily and efficiently manufactured and marketed.

It is a further object of the present invention to provide a new adjustable headwear for a child which is of a durable and reliable construction.

An even further object of the present invention is to provide a new adjustable headwear for a child which is susceptible of a low cost of manufacture with regard to both materials and labor, and which accordingly is then susceptible of low prices of sale to the consuming public, thereby making such adjustable headwear for a child economically available to the buying public.

Still yet another object of the present invention is to provide a new adjustable headwear for a child which provides in the apparatuses and methods of the prior art some of the advantages thereof, while simultaneously overcoming some of the disadvantages normally associated therewith.

Still another object of the present invention is to provide a new adjustable headwear for a child for allowing the child to continue to wear the hat or bonnet as the child grows.

Yet another object of the present invention is to provide a new adjustable headwear for a child which includes a crown member having a bottom edge and a top portion and being split through and from the bottom edge to a middle of the top portion thus forming a first end portion having a longitudinal edge and also forming a second end portion having a longitudinal edge, and also includes a bill member which is sewn to and extends from the crown member, and further includes a plurality of hook and loop fasteners which are sewn upon the exterior of the crown member along the longitudinal edge of the first end portion and which are also sewn on the underside of the crown member upon the second end portion. The second end portion is adjustably attached upon the first end portion to accommodate different head sizes of children wearing the adjustable headwear.

Still yet another object of the present invention is to provide a new adjustable headwear for a child that allows the child to keep and use this particular headwear for many years as he/she grows up.

Even still another object of the present invention is to provide a new adjustable headwear for a child that can be easily adjusted to fit better and more comfortable upon the child's head than any of the prior art.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
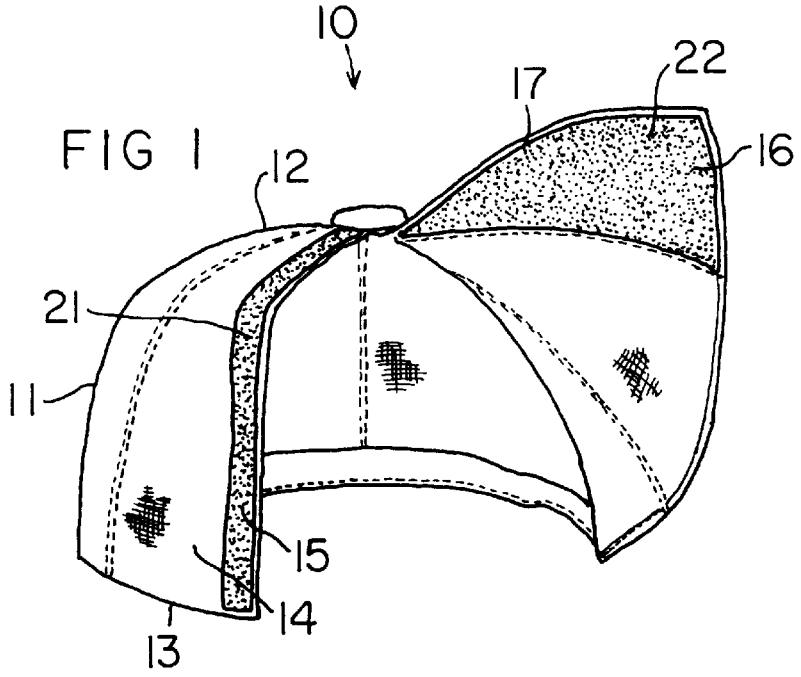
FIG. 1 is a perspective view of a new adjustable headwear for a child according to the present invention.
Figure 2:
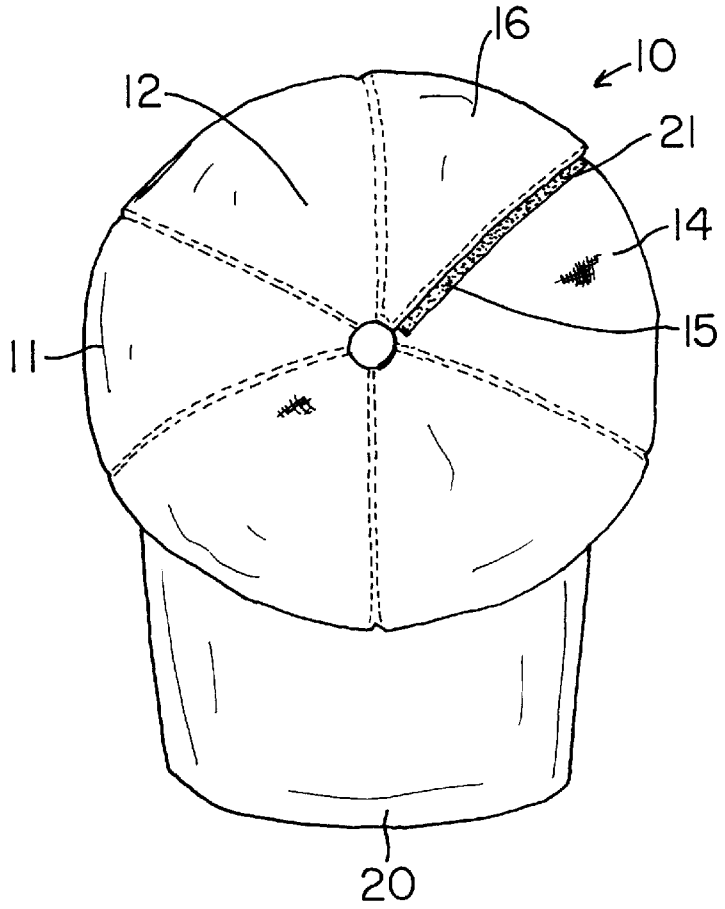
FIG. 2 is a top plan view of the present invention.

With reference now to the drawings, and in particular to FIGS. 1 through 2 thereof, a new adjustable headwear for a child embodying the principles and concepts of the present invention and generally designated by the reference numeral 10 will be described.

As best illustrated in FIGS. 1 through 2, the adjustable headwear for a child 10 generally comprises a crown member 11 having a bottom edge 13 and a top portion 12 and being split through and from the bottom edge 13 to a middle of the top portion 12 thus forming a first end portion 14 and a second end portion 16. The crown member 11 is capable of being adjusted to various sizes. The first end portion 14 includes a longitudinal edge 15 which extends from the bottom edge 13 to a middle of the top portion 12, and the second end portion 16 includes a longitudinal edge 17 which extends from the bottom edge 13 to a middle of the top portion 12. The longitudinal edges 15,17 merge at a middle of the top portion 12 of the crown member 11. The second end portion 16 is adjustably and detachably attachable upon the first end portion 14 to effectuate the various sizes of the crown member 11 for accommodating different head sizes of children. The split is located intermediate of a side of the crown member 11 and a back of the crown member 11. A bill member 20 is securely attached or sewn to the crown member 11 and extends outwardly therefrom. A plurality of hook and loop fasteners 21,22 are securely and conventionally disposed upon the crown member 11 and along the first 14 and second 16 end portions. The hook and loop fasteners 21,22 include a strip of hook and loop fasteners 15 securely fastened or sewn upon an exterior of the crown member 11 and extends along the longitudinal edge 15 of the first end portion 14, and further include and arrangement of the hook and loop fasteners 22 securely attached or sewn to an underside of the crown member 11 upon the second end portion 16 and along the longitudinal edge 17 thereof.

In use, the user can adjust the size of the crown member 11 by overlaying and attaching the second end portion 16 upon the first end portion 14 to accommodate the head size of the child who is going to wear the adjustable headwear 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable headwear for a child comprising:

a crown member having a bottom edge and a top portion and being split through and from said bottom edge to a middle of said top portion thus forming a first end portion having a first edge and a second end portion having a second edge, said first and second edges defining said split;

a bill member securely attached to said crown member and extending outwardly therefrom;

a plurality of hook and loop fasteners disposed upon said crown member and along said first and second end portions;

wherein a first one of said hook and loop fasteners comprises a strip of said hook and loop fasteners securely fastened upon an exterior of said first end portion of said crown member and extending substantially continuously along said first edge of said first end portion from said middle of said top portion to said bottom edge;

wherein a second one of said hook and loop fasteners comprises a panel of hook and loop fasteners securely fastened upon an interior of said second end portion of said crown member, said strip and said panel of said hook and loop fasteners each having a width measured parallel to said bottom edge; and wherein said width of said panel of said hook and loop fasteners is greater than said width of said strip of said hook and loop fasteners such that said panel is attachable to said strip at different positions on said panel to permit adjustment of a circumferential size defined by said bottom portion.

2. An adjustable headwear for a child as described in claim 1, wherein said longitudinal edge of said first end portion extends from said bottom edge to a middle of said top portion, and said second end portion includes a longitudinal edge which extends from said bottom edge to a middle of said top portion.

3. An adjustable headwear for a child as described in claim 2, wherein said longitudinal edges merge at a middle of said top portion of said crown member.

4. An adjustable headwear for a child as described in claim 3, wherein said second end portion is adjustably and detachably attachable upon said first end portion to effectuate the various sizes of said crown member for accommodating different head sizes of children.

5. An adjustable headwear for a child as described in claim 4, wherein said split is located intermediate of a side of said crown member and a back of said crown member.

6. An adjustable headwear for a child as described in claim 1, wherein said hook and loop fasteners include and arrangement of said hook and loop fasteners securely attached to an underside of said crown member upon said second end portion and along said longitudinal edge thereof.

7. An adjustable headwear for a child comprising:

a crown member having a bottom edge and a top portion and being split through and from said bottom edge to a middle of said top portion thus forming a first end portion and a second end portion, said crown member having adjustable and variable sizes, said first end portion including a longitudinal edge which extends from said bottom edge to a middle of said top portion, and said second end portion including a longitudinal edge which extends from said bottom edge to a middle of said top portion, said longitudinal edges merging at a middle of said top portion of said crown member, said second end portion being adjustably and detachably attachable upon said first end portion to effectuate the various sizes of said crown member for accommodating different head sizes of children, said split being located intermediate of a side of said crown member and a back of said crown member;

a bill member securely attached to said crown member and extending outwardly therefrom; and a plurality of hook and loop fasteners disposed upon said crown member and along said first and second end portions, and including a strip of said hook and loop fasteners securely fastened upon an exterior of said crown member and extending along said longitudinal edge of said first end portion, and also including an arrangement of said hook and loop fasteners securely attached to an underside of said crown member upon said second end portion and along said longitudinal edge thereof, a width of a portion of said hook and loop fasteners of said second end portion being greater than a width of said hook and loop fasteners of said first end portion.

* * * * *